US011904200B2

(12) United States Patent
Smith et al.

(10) Patent No.: US 11,904,200 B2
(45) Date of Patent: Feb. 20, 2024

(54) ROWING EXERCISE MACHINES HAVING A CONFIGURABLE ROWING FEEL

(71) Applicant: Hydrow, Inc., Cambridge, MA (US)

(72) Inventors: Bruce Smith, Cambridge, MA (US); Klaus Heribert Renner, Hollis, NH (US); William Churchill Taliaferro Burke, San Francisco, CA (US); Jose Oscar Mur-Miranda, Boston, MA (US); Christopher Olin Evans, Amherst, NH (US)

(73) Assignee: Hydrow, Inc., Boston, MA (US)

( * ) Notice: Subject to any disclaimer, the term of this patent is extended or adjusted under 35 U.S.C. 154(b) by 185 days.

(21) Appl. No.: 17/020,351

(22) Filed: Sep. 14, 2020

(65) Prior Publication Data

US 2021/0060378 A1 Mar. 4, 2021

Related U.S. Application Data

(62) Division of application No. 16/426,347, filed on May 30, 2019, now Pat. No. 10,828,531.

(51) Int. Cl.
*A63B 22/00* (2006.01)
*A63B 21/00* (2006.01)
(Continued)

(52) U.S. Cl.
CPC ..... *A63B 22/0076* (2013.01); *A63B 21/0056* (2013.01); *A63B 21/00076* (2013.01);
(Continued)

(58) Field of Classification Search
CPC ..... A63B 21/00076; A63B 21/0056; A63B 21/157; A63B 21/225; A63B 22/0076;
(Continued)

(56) References Cited

U.S. PATENT DOCUMENTS 2,002 A 3/1841 Rider
4,735,410 A * 4/1988 Nobuta ..... A63B 21/4047 482/901
(Continued)

FOREIGN PATENT DOCUMENTS

CN 1484538 3/2004
CN 101234224 8/2008
(Continued)

OTHER PUBLICATIONS

U.S. Appl. No. 15/981,834, filed May 16, 2018—Allowed, Submitted Oct. 10, 2019, Submitted Oct. 10, 2019.
(Continued)

*Primary Examiner* — Joshua Lee
(74) *Attorney, Agent, or Firm* — Fish & Richardson P.C.

(57) ABSTRACT

Among other things, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during part of a rowing stroke. The resistance to motion of the rowing grip during the drive phase of the rowing stroke conforms to a target feel for a rower. The target feel corresponds to a feel for a rower of a target other rowing exercise machine or other target feel of interest.

13 Claims, 8 Drawing Sheets

(51) Int. Cl.
*A63B 21/005* (2006.01)
*A63B 21/22* (2006.01)
*A63B 24/00* (2006.01)
*A63B 71/06* (2006.01)

(52) U.S. Cl.
CPC ..... *A63B 21/157* (2013.01); *A63B 21/225* (2013.01); *A63B 24/0087* (2013.01); *A63B 71/0619* (2013.01); *A63B 2022/0079* (2013.01); *A63B 2024/0093* (2013.01); *A63B 2071/0655* (2013.01); *A63B 2220/30* (2013.01); *A63B 2220/833* (2013.01)

(58) Field of Classification Search
CPC ..... A63B 24/0087; A63B 71/0619; A63B 2022/0079; A63B 2024/0093; A63B 2071/0655; A63B 2220/30; A63B 2220/833
See application file for complete search history.

(56) References Cited

U.S. PATENT DOCUMENTS 4,798,378 A * 1/1989 Jones ..... A63B 22/0076 482/72
4,984,986 A 1/1991 Vohnout
5,076,573 A * 12/1991 Lo ..... A63B 22/0076 482/903
5,409,435 A * 4/1995 Daniels ..... F16D 57/002 482/901
5,466,200 A 11/1995 Ulrich et al.
5,656,001 A 8/1997 Baatz
5,772,560 A 6/1998 Watterson et al.
6,447,424 B1 9/2002 Ashby et al.
6,601,016 B1 7/2003 Brown et al.
6,626,799 B2 9/2003 Watterson et al.
6,701,271 B2 3/2004 Willner et al.
6,749,537 B1 6/2004 Hickman
6,808,472 B1 10/2004 Hickman
6,902,513 B1 6/2005 McClure
6,921,351 B1 7/2005 Hickman et al.
6,945,917 B1 9/2005 Baatz
7,166,064 B2 1/2007 Watterson et al.
7,311,640 B2 12/2007 Baatz
7,556,590 B2 7/2009 Watterson et al.
7,628,730 B1 12/2009 Watterson et al.
7,769,794 B2 8/2010 Moore et al.
7,874,957 B2 1/2011 Hurwitz et al.
7,946,961 B2 5/2011 Blum et al.
8,103,517 B2 1/2012 Hinnebusch
8,152,696 B2 4/2012 Blum et al.
8,409,057 B2 4/2013 Martens
8,622,876 B2 1/2014 Kelliher
8,684,888 B2 4/2014 Blum et al.
9,174,085 B2 11/2015 Foley et al.
9,233,276 B1 1/2016 Foley et al.
9,302,152 B2 4/2016 Blum et al.
9,861,855 B2 1/2018 Foley et al.
9,974,995 B2 5/2018 Hall
10,322,315 B2 6/2019 Foley et al.
10,471,297 B1 11/2019 Smith et al.
10,486,026 B2 11/2019 Foley et al.
10,610,725 B2 * 4/2020 Schaefer ..... G16H 20/30
10,639,521 B2 5/2020 Foley et al.
10,828,531 B1 11/2020 Smith et al.
10,946,263 B2 3/2021 Felker
10,956,630 B2 3/2021 Le Chevalier et al.
11,130,017 B2 9/2021 Smith et al.
11,229,825 B1 1/2022 Wachirajindakul et al.
2005/0164833 A1 7/2005 Florio
2007/0219059 A1 9/2007 Schwartz et al.
2008/0005276 A1 1/2008 Frederick
2008/0052756 A1 2/2008 Morishige et al.
2008/0280736 A1 * 11/2008 D'Eredita ..... A63B 69/06 482/72
2009/0075782 A1 3/2009 Joubert et al.
2009/0164448 A1 6/2009 Curtis
2009/0233769 A1 9/2009 Pryor
2009/0291726 A1 11/2009 Svensson
2009/0291805 A1 11/2009 Blum et al.
2010/0144497 A1 6/2010 Clark
2010/0173749 A1 7/2010 Lannon et al.
2010/0248906 A1 9/2010 Eredita et al.
2011/0082009 A1 4/2011 Ranky et al.
2011/0105281 A1 * 5/2011 Jerichow ..... A61B 5/222 345/184
2011/0201477 A1 8/2011 Blum et al.
2011/0245044 A1 10/2011 Kelliher
2012/0120771 A1 5/2012 Lapides
2012/0237910 A1 9/2012 Blum et al.
2013/0130206 A1 * 5/2013 Smith ..... A63B 24/0006 434/29
2013/0274635 A1 10/2013 Coza
2014/0172135 A1 6/2014 Eisner
2014/0244010 A1 8/2014 Harvey
2014/0337450 A1 11/2014 Choudhary
2015/0057130 A1 * 2/2015 Lin ..... A63B 21/225 482/72
2015/0360083 A1 12/2015 Lagree et al.
2016/0287939 A1 * 10/2016 Deochand ..... A63B 24/0062
2017/0319889 A1 * 11/2017 Cei ..... A63B 21/151
2017/0319904 A1 * 11/2017 Deochand ..... A63B 71/0622
2017/0319906 A1 11/2017 Chang et al.
2018/0056132 A1 3/2018 Foley et al.
2018/0099178 A1 * 4/2018 Schaefer ..... A63B 24/0075
2018/0126249 A1 5/2018 Consiglio
2018/0140903 A1 5/2018 Poure et al.
2018/0161658 A1 6/2018 Felker
2018/0214729 A1 8/2018 Rubin et al.
2018/0264366 A1 9/2018 Kawahara
2018/0285496 A1 10/2018 Le Chevalier et al.
2018/0339195 A1 11/2018 Bernotas
2019/0070448 A1 * 3/2019 Jeremic ..... A63B 21/0059
2019/0126099 A1 5/2019 Hoang
2019/0255386 A1 8/2019 Trotter
2019/0290964 A1 9/2019 Oren
2019/0336827 A1 11/2019 Intonato et al.
2019/0351283 A1 11/2019 Smith et al.
2020/0078635 A1 3/2020 Smith et al.
2020/0376328 A1 12/2020 Smith et al.
2021/0402250 A1 12/2021 Smith et al.
2022/0143465 A1 5/2022 Wachirajindakul et al.

FOREIGN PATENT DOCUMENTS

CN 202179824 4/2012
CN 204219688 3/2015
CN 205699387 11/2016
CN 107970562 5/2018
CN 110327587 10/2019
EP 0919259 6/1999
RU 2630436 9/2017
TW M554814 2/2018
WO WO9606664 3/1996
WO WO2005087323 9/2005
WO WO2017008775 1/2017

OTHER PUBLICATIONS

U.S. Appl. No. 16/588,385, filed Sep. 30, 2019—Pending, Submitted Oct. 10, 2019, Submitted Oct. 10, 2019.
U.S. Appl. No. 16/426,347, filed May 30 ,2019—Pending, Submitted Oct. 10, 2019, Submitted Oct. 10, 2019.
U.S. Appl. No. 17/001,285, filed Aug. 24, 2020.
'www.commonwealthmagazine.org' [online] "Bruce Smith wants to take rowing to a new level," Apr. 2015 [retrieved May 9, 2018]. Retrieved from the Internet: URL <https://commonwealthmagazine.org/environment/bruce-smith-wants-to-take-rowing-to-a-new-level/>. 25 pages.
'www.concept2.com' [online]. "Concept 2—The world's leading rowing machine," Dec. 25, 1996 [retrieved on May 9, 2018].

(56) References Cited

OTHER PUBLICATIONS

Retrieved from the Internet: URL http://www.concept2.com/. 2 pages.
'www.liverowing.com' [online]. "Liverowing," Feb. 2, 2011 [retrieved on May 9, 2018]. Retrieved from URL <https://liverowing.com/>. 5 pages.
'www.onepeloton.com' [online]. "The Peloton Bike: Live studio cycling, ready when you are," Sep. 22, 2017 [retrieved on May 9, 2018]. Retrieved from the Internet: URL <https://www.onepeloton.com/>. 9 pages.
'www.rowlab.com' [online]. "Stream Live and On-Demand Rowing Classes," 2017 [Retrieved on May 9, 2018]. Retrieved from the Internet: URL <https://rowlab.co/>. 4 pages.
'www.truerowing.com' [online]. "Crew by True Rowing: Redefining indoor workouts," [retrieved on May 9, 2018]. Retrieved from the Internet: URL <http://www.truerowing.com/>. 5 pages.
Flywheelsports.com [online], "Take the class of your life, your first fly is free", Published on or before May 30, 2019, retrieved on Mar. 18, 2020, retrieved from URL<https://www.flywheelsports.com/> 5 pages.
Mogan et al., "To be in synchrony or not? A meta-analysis of synchrony's effects on behavior, perception, cognition and affect," Journal of Experimental Social Psychology, 2017, 72: 13-20.
Office Action in U.S. Appl. No. 16/426,347, dated Aug. 5, 2019, 12 pages.
PCT International Search Report and Written Opinion in International Application No. PCT/US2019/30646, dated Aug. 29, 2019, 18 pages.
PCT International Search Report and Written Opinion in International Appln. No. PCT/US2020/032132, dated Aug. 18, 2020, 15 pages.
ProForm.com [online], "Rowers", published on or before May 30, 2019, retrieved from URL<https://www.proform.com/rowing-machines/750r-rower> 15 pages.
'www.concept2.com' [online]. "How to Use Your PM4," Aug. 28, 2012 [retrieved on Jun. 3, 2019]. Retrieved from the Internet: URL <https://www.concept2.com/service/monitors/pm4/how-to-use/viewing-drag-factor>. 2 pages.
'www.thestrokemaster.com' [online]. "The Stroke Master Elite Rowing Trainer," 2019 [retrieved on Jun. 10, 2019]. Retrieved from the Internet: https://thestrokemaster.com/products/. 6 pages.
Yogatoday.com [online], "Your Yogatoday Studio", published on or before May 30, 2019, retrieved on Mar. 18, 2020, retrieved from URL<https://www.yogatoday.com/>, 5 pages.
PCT International Preliminary Report on Patentability in International Appln. No. PCT/US2019/030646, dated Nov. 17, 2020, 10 pages.
Chinese Office Action in CN Appln. No. 201980047722.3, dated Oct. 20, 2021, 18 pages with English Translation.
European Search Report in EP Appln. No. 19803716, dated Jan. 26, 2022, 12 pages.
PCT International Search Report and Written Opinion in International Appln. No. PCT/US2021/047249, dated Sep. 20, 2021, 10 pages.
Support.hydrow.com [online], "How the Leaderboard Works", published on Jul. 30, 2019, retrieved on Sep. 13, 2021, retrieved from URL<https://support.hydrow.corn/hc/en-us/articles/360031429651-How-the-Leaderboard-Works>.
Taiwanese Office Action in TW Appln. No. 109117615, dated Dec. 29, 2020, 19 pages with English Translation.
Chinese Office Action in CN Appln. No. 202080053324.5, dated Nov. 17, 2022, 10 pages (with English translation).
Japanese Office Action in JP Appln. No. 2020-564448, dated May 9, 2023, 10 pages (with English Translation).
PCT International Preliminary Report on Patentability in International Appln. No. PCT/US2021/047249, dated Mar. 9, 2023, 9 pages.

* cited by examiner

TRIANGLES REPRESENT SCALING FACTORS: CURRENT GAIN, SPEED GAIN AND CURRENT GAIN

THICK LOOP HIGHLIGHTS THE REAL-TIME CALIBRATION FEEDBACK LOOP

ROWING EXERCISE MACHINES HAVING A CONFIGURABLE ROWING FEEL

RELATED APPLICATION

This application is a divisional of U.S. patent application Ser. No. 16/426,347, filed on May 30, 2019, which is incorporated here by reference in its entity.

BACKGROUND

This description relates to rowing exercise machines (e.g., ergometers) having a configurable rowing feel.

Mechanical Ergometers

Rowing (both in a real boat or on a rowing exercise machine, or ergometer) entails a sequence of strokes 8. FIG. 1 illustrates this sequence. Each stroke can be understood as divided in two phases.

The first phase 10 is the drive phase, in which the rower applies a pulling force 11 horizontally on a handle or other grip 12 (or on an oar, in the case of a real boat) beginning at an initial position 13. The rower does work to increase the rotational speed of a flywheel of the rowing exercise machine (or the speed in the water of the mass of a real boat) and eventually reaches a final position 15.

The second phase 14 is the recovery phase, which begins at the final position and in which the rower allows the handle (or oar) to return to the initial position. The beginning and end of the drive are also known as the catch 16 and the finish 18, respectively. The beginning and end of the recovery are the finish and the catch respectively. The catch and finish are instants in time, while the drive and recovery are intervals of time.

During the drive phase, the rower applies a relatively large pulling force, and during the recovery phase, the rower applies a relatively small force allowing the handle to return to the initial position at the catch. At the end of the stroke, another stroke begins with a new drive phase.

FIG. 2 shows components of an exercise machine 20 (such as a configurable-feel ergometer called the Hydrow™ and available from CREW by True Rowing of Cambridge, Massachusetts, and the exercise machine described in U.S. patent application Ser. No. 15/981,834, filed on May 16, 2018, the entire contents of which are incorporated here by reference). FIG. 2 also illustrates relevant variables that can be measured and used in analyzing and controlling operation of the exercise machine.

During the drive, the rower pulls on the handle 12 with a pulling force f and at a pulling speed u. A positive pulling speed u increases the handle position x from the initial position 13 toward the finish position during the drive. The minimum (initial) position x is at the catch, and the maximum (final) position 15 is at the finish. The pulling force f is transmitted to a flywheel 24 having a moment of inertia I through a one-way clutch 26 (including a return spring 28), such that the handle is engaged by the clutch to the flywheel only during the drive. When the handle is pulled during the drive, the handle strap 30 turns the clutch clockwise and rotates the flywheel clockwise through a belt 32. The pulling force f applied by the rower to the handle exerts a positive handle torque $\tau_h$ on the flywheel (in the clockwise direction in the figure) during the drive. When the net torque on the flywheel (including the handle torque in the opposing torque represented by the inertia of the flywheel) is positive, the rotational flywheel speed ω will increase.

During the recovery, the clutch disengages the flywheel from the handle, allowing the return spring to pull the handle back to the catch position. Because the handle torque $\tau_h$ exerted by the rower on the handle corresponds to a zero torque on the flywheel during the return, the flywheel speed will decrease in a manner that depends on its inertia and on the other torques acting on it.

FIG. 3 shows the flywheel speed ω and handle torque $\tau_h$ as functions of time, and illustrates a case in which the average flywheel speed is increasing from one stroke to a successive stroke as shown. FIG. 3 also illustrates that, typically, the pulling force f (and the corresponding handle torque $\tau_h$) applied by the rower to the handle is not constant during the entire drive phase but can vary according to a profile of forces or torques over time or position or both.

SUMMARY

Below, we describe technology that can impart to ergometers a configurable rowing feel. We sometimes refer to such ergometers as configurable-feel ergometers. We use the term "configurable rowing feel" broadly to include, for example, a rowing force f imposed on the rower by the handle for a given set of parameter values. Rowing feel can be set, adjusted, or changed to mimic, duplicate, or have a particular similarity to or difference from a target rowing feel. We use the term "target rowing feel" or simply "target feel" broadly to include, for example, any one or more rowing feels that are desired, intended, preferred, or otherwise of interest to a rower, a manufacturer, or a supplier of ergometers. A target rowing feel can be a feel of a known design or model of mechanical or other ergometer, a rowing feel of a real boat, an experimental rowing feel under study, a proposed rowing feel, or any other rowing feel that is useful, necessary, or of interest, or combinations of them.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during a part of a rowing stroke. The resistance to motion of the rowing grip during the drive phase conforms to a target feel for a rower. The target feel corresponds to a feel for a rower of a target other rowing exercise machine.

Implementations may include one or a combination of two or more of the following features. The movable inertial element includes a flywheel and the eddy current brake is coupled to the flywheel to cause the resistance to motion of the rowing grip during the drive phase of the rowing stroke. The rowing grip includes a handle coupled to the movable inertial element through a flexible elongated element. The control circuitry includes a sensor to measure a position or velocity or both of the movable inertial element. The control circuitry includes storage for information about relationships among velocities of the movable inertial element, currents applied to the eddy current brake, and amounts of resistance to motion of the rowing grip. The target other rowing exercise machine includes an identified model of a mechanical rowing exercise machine. The feel for a rower includes a profile of amounts of resistance to motion of the grip during part or all of the drive phase.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during a part of a rowing stroke. The resistance to motion of the rowing grip during the drive phase conforms within a predetermined precision of feel and accuracy of feel to a target feel for a rower of the rowing exercise machine over time and to a target feel to which other rowing exercise machines of a set of rowing exercise machines also conform.

Implementations may include one or a combination of two or more of the following features. The rowing exercise machine and the set of rowing exercise machines are of a particular design or model. The control circuitry includes storage for information representing the target feel and relationships among velocities of the movable inertial element, currents applied to the eddy current brake, and amounts of resistance to motion of the rowing grip.

Implementations may include one or a combination of two or more of the following features. The target feel includes a profile of amounts of resistance to motion of the rowing grip during part or all of the drive phase. The target feel includes a feel of a target other rowing exercise machine.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during part of a rowing stroke. The resistance to motion of the rowing grip during the drive phase conforms to a target feel for a rower within a specified accuracy of feel.

Implementations may include one or a combination of two or more of the following features. The target feel includes a profile of resistance to motion of the rowing grip during part or all of the drive phase. The control circuitry is configured to maintain the resistance to motion of the rowing grip during the drive phase within a pre-specified amount of error relative to the resistance to motion of the rowing grip of the target feel. Information is stored representing the target feel and an eddy current brake model.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during part of a rowing stroke. The resistance to motion of the rowing grip during the drive phase conforms to a target feel for a rower within a specified precision of feel.

Implementations may include one or a combination of two or more of the following features. The target feel includes a profile of resistance to motion of the rowing grip during part or all of the drive phase. The control circuitry is configured to maintain the resistance to motion of the rowing grip during the drive phase within a pre-specified amount of variation relative to the resistance to motion of the rowing grip of the target feel. Information is stored representing the target feel and an eddy current brake model.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during a part of a rowing stroke and to cause essentially no resistance during a portion of a rowing stroke other than the drive phase. The resistance to motion of the rowing grip during the drive phase conforms to a target feel for a rower. The control circuitry controls the resistance to motion of the rowing grip during the drive phase based on information about the movable inertial element acquired during the portion of the rowing stroke other than the drive phase.

Implementations may include one or a combination of two or more of the following features. The control circuitry includes an element to measure a position or speed of the movable inertial element and the information about the movable inertial element acquired during the portion of the rowing stroke other than the drive phase includes a speed of the moving element. The portion of the rowing stroke other than the drive phase includes the recovery phase.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during part of a rowing stroke and to cause essentially no resistance during a portion of a rowing stroke other than the drive phase. The resistance to motion of the rowing grip during the drive phase conforms to a target feel for a rower and being based on information acquired by the control circuitry about motion of the movable inertial element. The information is acquired while causing the resistance to motion of the rowing grip to include a feature that the rower does not experience as part of the feel of the rowing exercise machine.

Implementations may include one or a combination of two or more of the following features. The control circuitry is configured to acquire the information by causing resistance to motion of the rowing grip at a frequency that the rower does not experience. The frequency includes a frequency higher than the rower can experience. The frequency includes a frequency lower than the rower can experience. The resistance that has the frequency lower than the rower can experience also has a magnitude lower than the rower can experience. The control circuitry is configured to acquire the information during the portion of the rowing stroke other than the drive phase. The portion of the rowing stroke other than the drive phase includes a recovery phase.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during part of a rowing stroke. The resistance to motion of the rowing grip during the drive phase conforms to a target feel for a rower. Storage contains information defining the target feel and is usable by the control circuitry to impart the target feel to the rower. The target feel includes any arbitrary target feel.

Implementations may include one or a combination of two or more of the following features. The information contained in the storage is not changeable. The information contained in the storage is changeable to information received at the rowing exercise machine through the Internet. The information contained in the storage is changeable in response to inputs from user interface controls of the user interface. The target feel includes a feel of an existing model or design of a mechanical ergometer. The target feel is the same as the target feels of other rowing exercise machines of a given model or design. The target feel applies to all of the successive strokes during a rowing session of the rower. The target feel is different for different strokes during a rowing session of the rower. The target feel includes a term proportional to the speed of the movable inertial element. The target feel includes a term proportional to a distance by which the rowing grip has been pulled by the rower during a stroke. The target feel includes a parameter external to the ergometer. The parameter includes a heartbeat rate of the rower. The target feel varies with the durations of strokes of a rower during a rowing session.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during part of a rowing stroke. The resistance to motion of the rowing grip during the drive phase conforms to a target feel for a rower. The machine includes a storage for instructions executable by the control circuitry to determine a requested amount of resistance to be applied to the rowing grip. The instructions include a linear least-squares regression based on measurements that relate current in the eddy current brake, speed of the movable inertial element, and drag.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during part of a rowing stroke. The resistance to motion of the rowing grip during the drive phase conforms to a target feel for a rower. The machine includes a storage for a torque table usable by the control circuitry to determine a requested amount of resistance to be applied to the rowing grip by applying a bilinear approximation.

Implementations may include one or a combination of two or more of the following features. Instructions contained in the storage are executable by the control circuitry to recompute the torque table to correct a deviation of an actual feel of the rowing exercise machine from the target feel.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during part of a rowing stroke. The resistance to motion of the rowing grip during the drive phase conforms to a target feel for a rower. The machine includes a storage for instructions executable by the control circuitry to determine a requested amount of drag to be applied to the rowing grip using a closed form calculation.

In general, in an aspect, a rowing exercise machine includes a movable inertial element, an eddy current brake coupled to the movable inertial element, a rowing grip coupled to the movable inertial element, and control circuitry coupled to the eddy current brake to cause a resistance to motion of the rowing grip during part of a rowing stroke. The resistance to motion of the rowing grip during the drive phase conforms to a target feel for a rower. The machine includes a storage for instructions executable by the control circuitry to apply a fixed eddy current brake model using a requested torque and a measured speed to determine a requested current and to apply scaling factors to one or more of the requested drag, the measured speed, and the requested current.

These and other aspects, features, implementations, and advantages (a) can be expressed as methods, apparatus, systems, components, program products, business methods, means or steps for performing functions, and in other ways, and (b) will become apparent from the following description and from the claims.

DESCRIPTION

Figure 7:
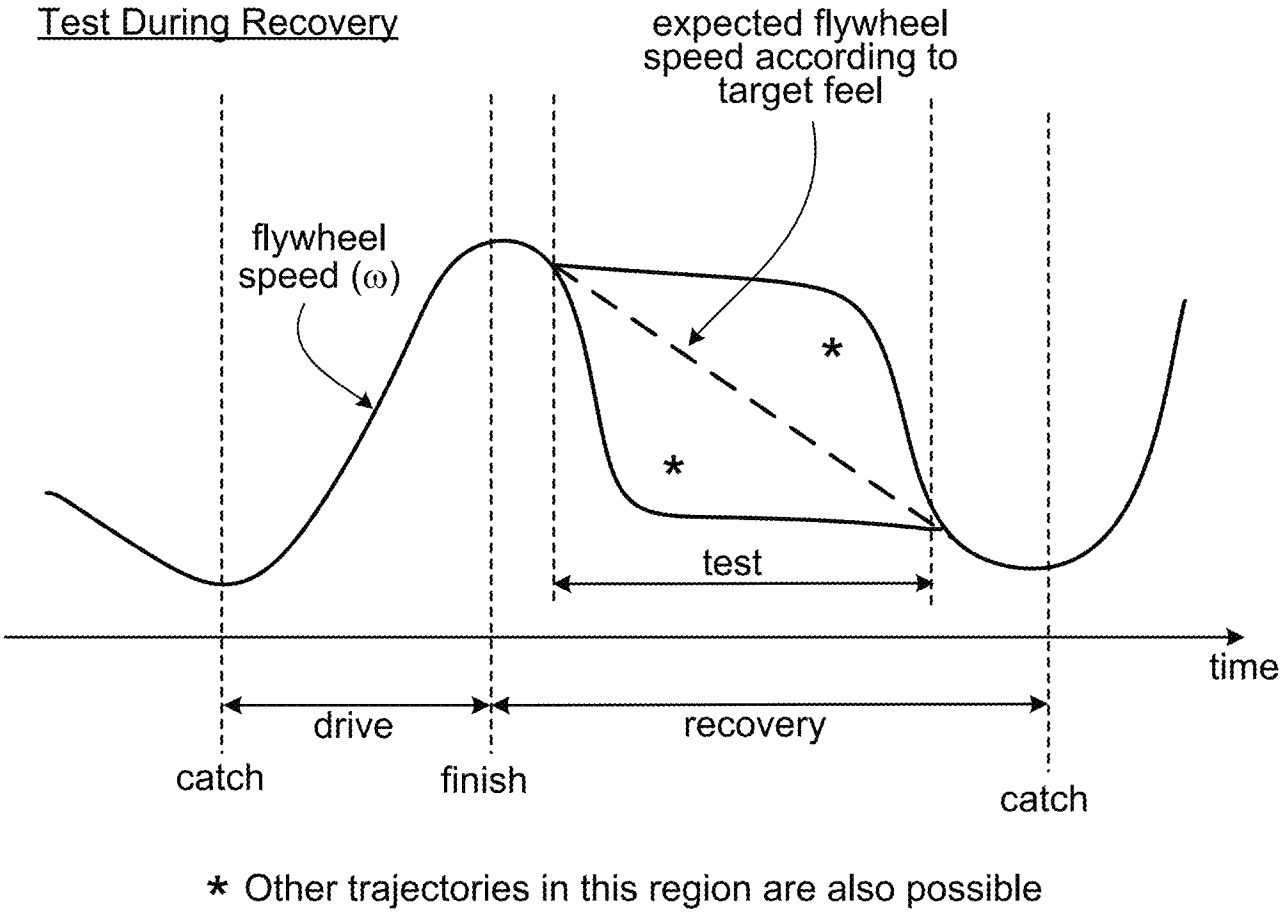

FIG. 7 schematically illustrates a test method.

Figure 8:
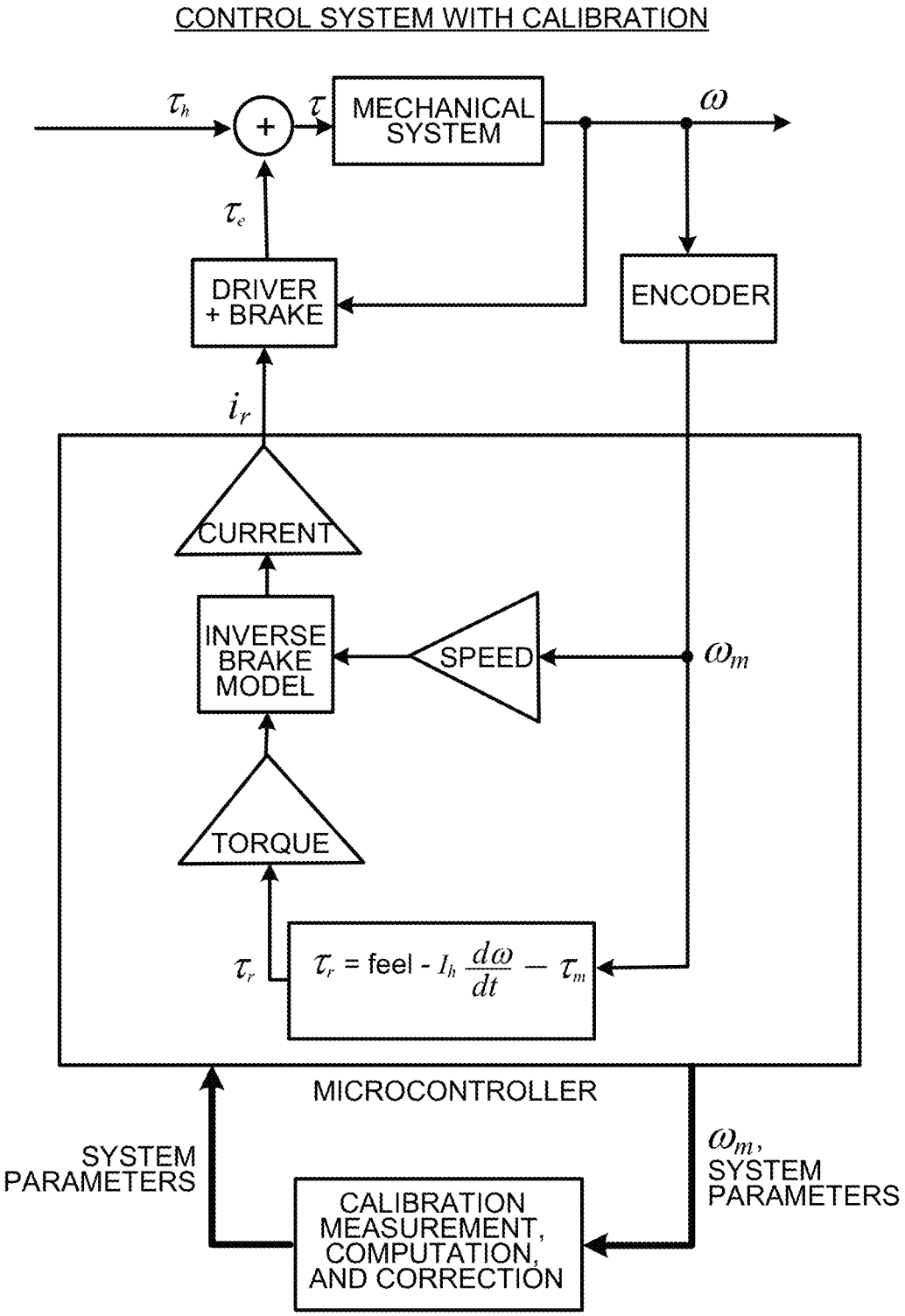

FIG. 8 is a block diagram of a control system with calibration.

On a mechanical rowing ergometer (or on a boat), the torques acting on the flywheel (or forces acting on the mass of the boat) are a drag torque exerted by air resistance on the flywheel (or a drag force exerted by water resistance on the boat) and an opposing handle torque $\tau_h$. The handle torque is transmitted mechanically from the rower's pulling force f applied to the handle. Drag torque (or force on a boat) is equal to a drag factor k times the square of the rotational flywheel speed (or square of the speed of the boat relative to the water).

As described in the previous paragraph, the mechanical model of a boat on water or of a mechanical rowing ergometer are identical if the mass of the boat is replaced by the moment of inertia of the flywheel and the forces are replaced by torques. Without any loss of generality, the equations that follow are given in the context of a flywheel and associated torques.

Mathematically, the drag and handle torques act on the moment of inertia of the flywheel such that $$I\frac{d\omega}{dt} = \tau_h - k\omega^2$$

Therefore, the handle torque is $$\tau_h = I\frac{d\omega}{dt} + k\omega^2$$

Since the handle torque on the flywheel is proportional to the pull force f at the handle (i.e., $f \propto \tau_h$) during the drive, the rower must exert a force f at the handle proportional to the moment of inertia and the drag torque such that $$f \propto I\frac{d\omega}{dt} + k\omega^2$$

In this case, this opposing force f applied at the handle against the rower's pull during the drive is uniquely defined by the speed of the flywheel and its derivative.

However, the force f can depend on other variables, such as position of the handle, temperature, and even the heartbeat of the rower. We define rowing feel f as the force imposed on the rower by the handle for a given set of parameter values rather than as a subjective human perception of the force. For example, we can define the force f as a function of position and time as the handle moves from the position at the catch to the position at the finish, at ambient temperature, at a particular date and time of a training schedule, with a particular heartbeat and skin resistance, and in response to live interactions with external observers.

We define precision of feel as an error measurement (for example, a root mean square error measurement) of the variation among the feels of all machines of a given model or design at all times of use. Precision of feel defined this way incorporates variations attributable to the design or model of the rowing exercise machine, manufacturing processes, usage, and environment, and combinations of them, among others. In situations for which calculating the exact precision of feel may be unreasonable or impossible, appropriate statistical techniques can be used instead.

Similarly, we define accuracy of feel as an error measurement of the differences between the feels of all machines of a given design or model at all times of use and a given target feel.

Figure 4:
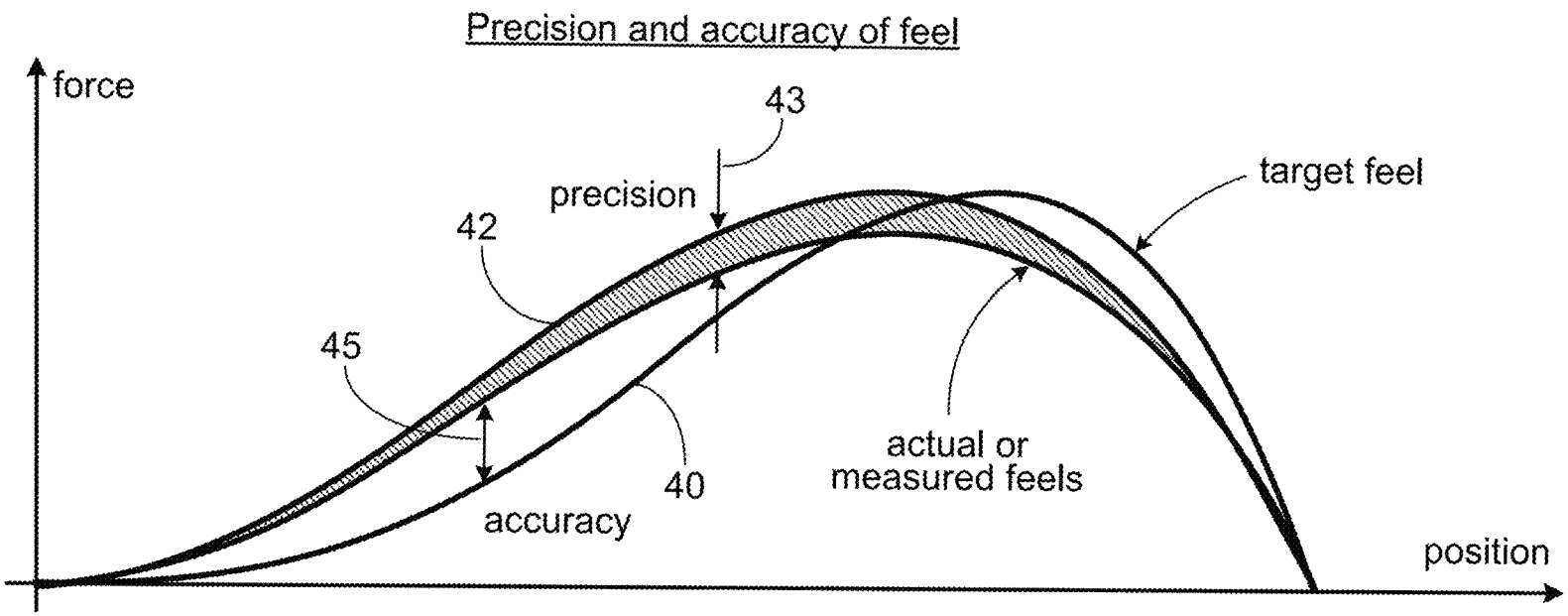
FIG. 4 shows graphs of precision and accuracy.

FIG. 4 illustrates these definitions. The single line 40 represents an arbitrary target feel versus handle position. The shaded curve 42 represents a collection of actual or measured feels f felt by a rower or rowers at each position of the handle for all machines, at all times of use, or any other collection of interest as defined by precision of feel. The variation of the feel f is precision of feel 43 and the difference between the actual feel and the target feel at each position is the accuracy of feel 45.

Each design or model of mechanical ergometer is characterized by a particular feel and by a precision of feel and an accuracy of feel which are governed by the mechanical design and manufacturing uniformity, among other things. The feel f of a given mechanical ergometer can change over time (over both short periods and long periods) and can differ from other mechanical ergometers of the same design or model.

The Importance of Rowing Exercise Machine Feel

Ergometer feel, precision of feel, and accuracy of feel are important to rowers, manufacturers, and suppliers of ergometers. Rowers may become accustomed to a particular feel of a particular design or model of ergometer and may prefer to row on exercise rowing machines that exhibit that particular feel. In some cases, a rower may want to use machines having different feels at different times and for different purposes. For example, rowers might need to train for peak performance in a particular boat for a particular race at a particular environment (which can include temperature, other competitors and cheering observers). A rower might need to maintain a safe heartbeat and avoid muscle or joint injuries, maybe as result of a previous injury and as part of rehabilitation training. A rower might use machines in competitions that demand careful and consistent performance to ensure fairness. Beginner and fragile rowers might need feels that avoid any jerks and can accommodate rowing variation or mistakes without causing injury. Manufacturers and suppliers are expected to provide exercise rowing machines that have good precision of feel and good accuracy of feel in order to satisfy rowers' expectations and create new experiences as previously described.

Ergometers Having a Configurable Feel

Here we describe a technology that can impart to ergometers a configurable rowing feel. We sometimes refer to such ergometers as configurable-feel ergometers. We use the term "configurable rowing feel" broadly to include, for example, a rowing feel that can be set, adjusted, or changed to mimic, duplicate, or have a particular similarity to or difference from a target rowing feel. We use the term "target rowing feel" broadly to include, for example, any one or more rowing feels that are desired, intended, preferred, or otherwise of interest to a rower, a manufacturer, or a supplier of ergometers. A target rowing feel can be a feel of a known design or model of mechanical or other ergometer, a rowing feel of a real boat, an experimental rowing feel under study, a proposed rowing feel, or any other rowing feel that is useful, necessary, or of interest, or combinations of them.

Figure 1:
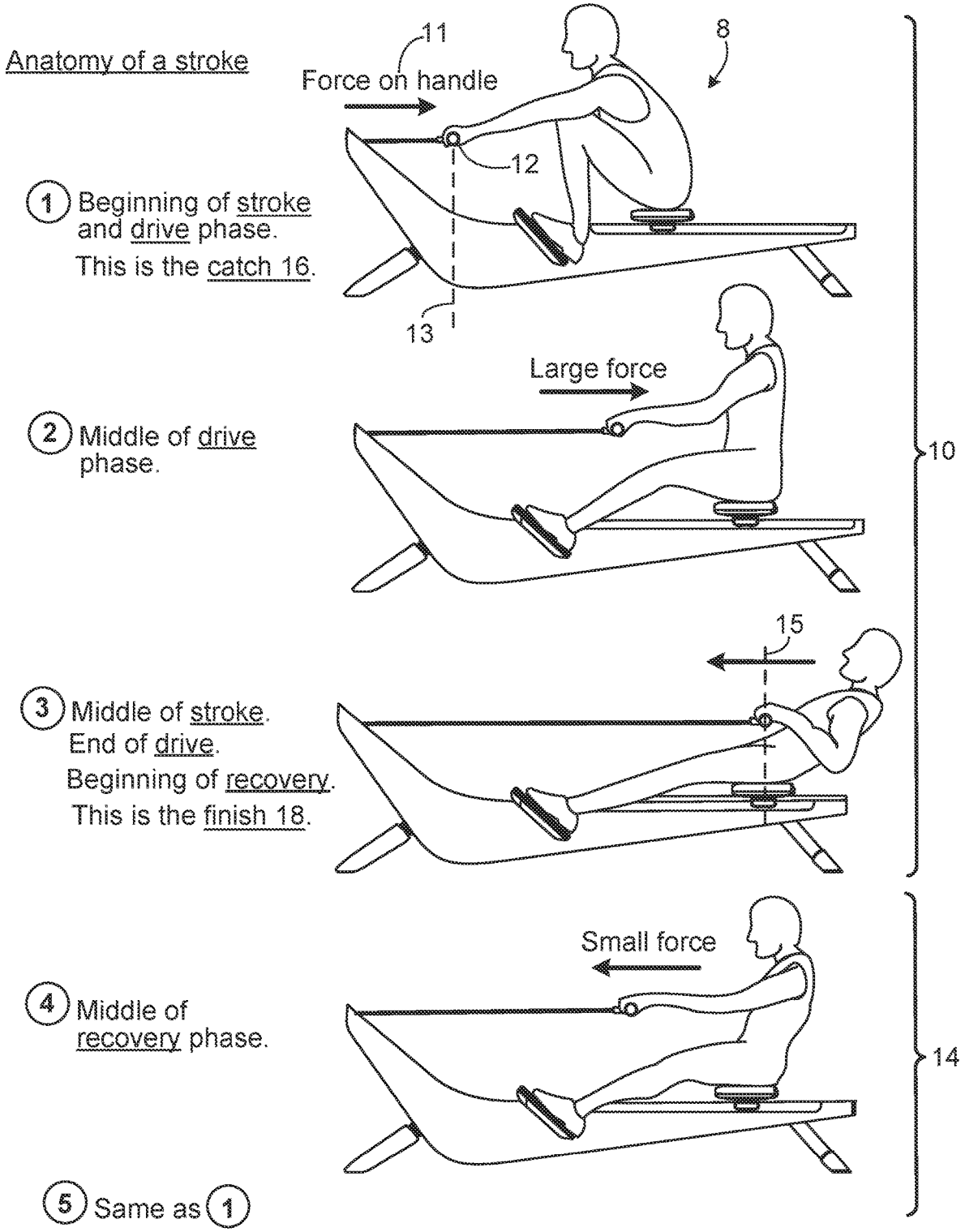
FIG. 1 shows an anatomy of a rowing stroke schematically.
Figure 2:
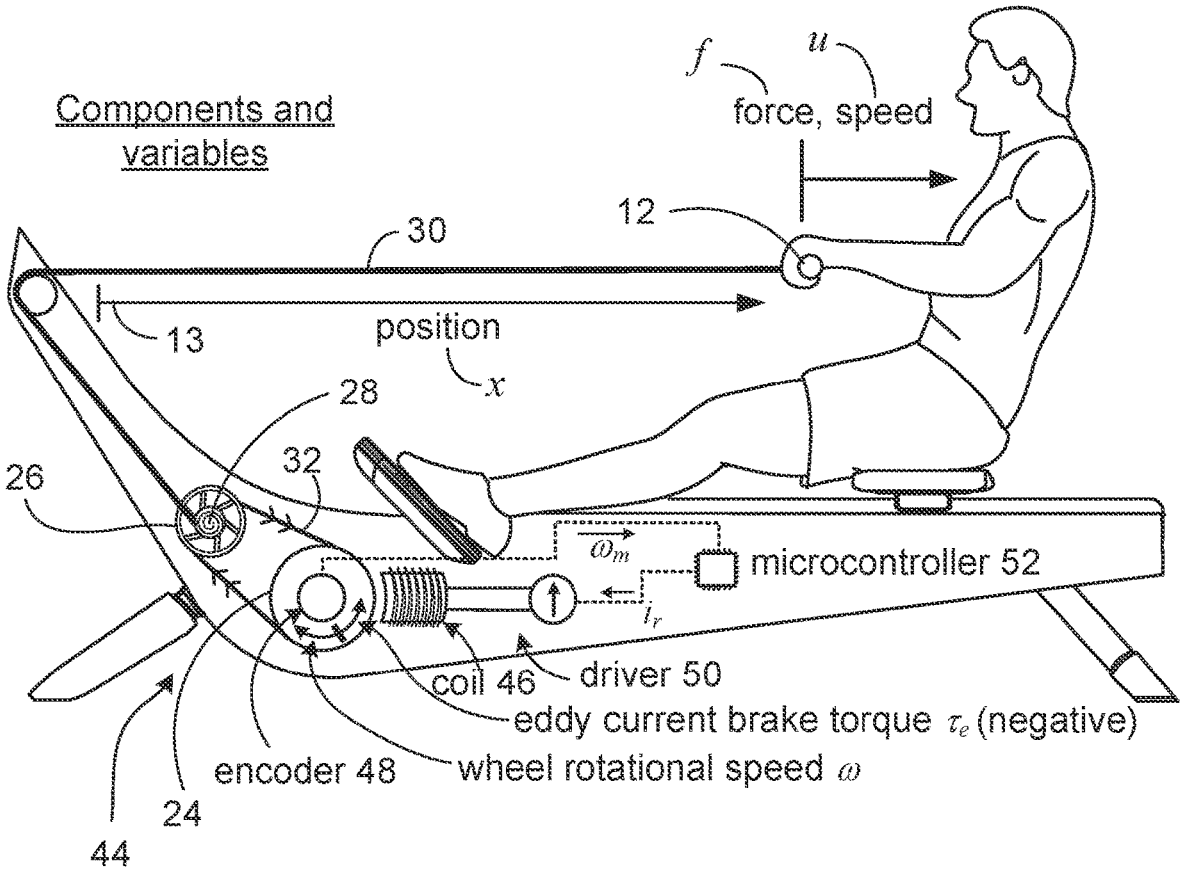
FIG. 2 shows a schematic side view of a rowing exercise machine.
Figure 2:
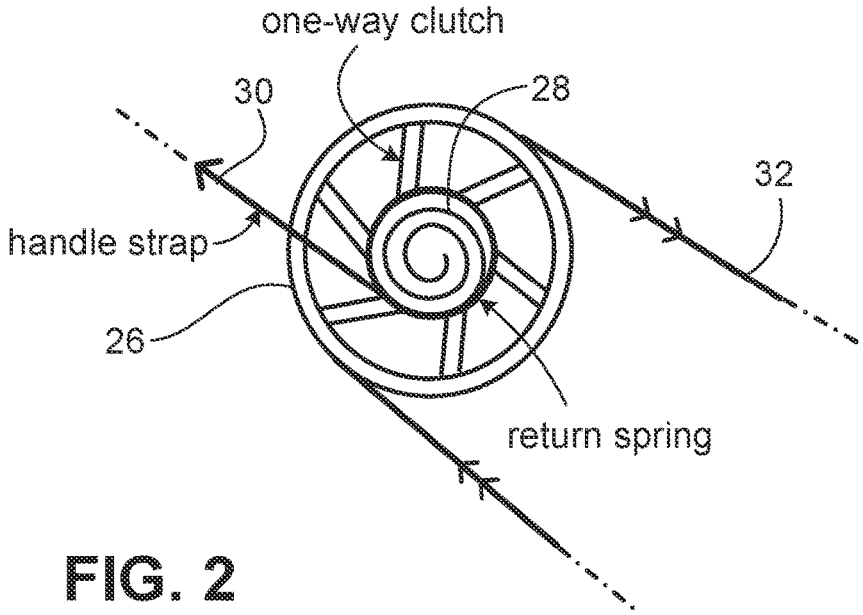
Figure 3:
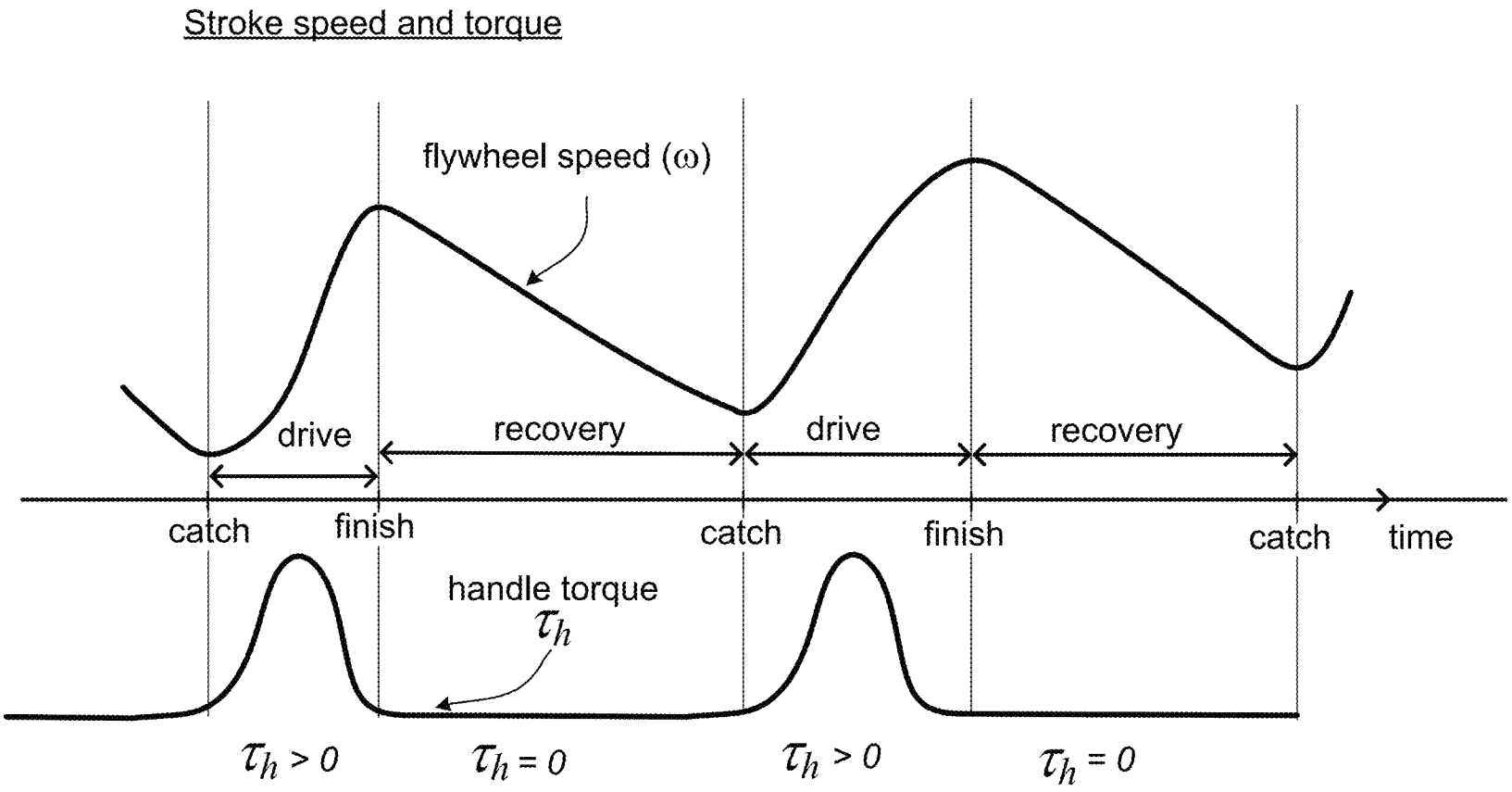
FIG. 3 shows graphs of speed and torque versus time.

Some implementations of configurable-feel ergometers that we describe here are based on the Hydrow ergometer. FIG. 2 shows components of an example configurable-feel ergometer such as the Hydrow. Unlike a mechanical ergometer (or a boat), the flywheel of a configurable-feel ergometer is not subject to air-based drag forces; it is, however, subject to a small mechanical torque $\tau_m$ attributable to mechanical losses. Instead of air-based drag, the flywheel on a configurable-feel ergometer is subject to an electromagnetic resistance as a result of its role as a component of an eddy current brake 44.

In an eddy current brake of the configurable-feel ergometers that we describe here, the flywheel 24 includes conductive material and provides resistance as a result of interaction of the conductive material with one or more electromagnetic coils 46 placed close to the flywheel. Current passed through the coil or coils causes the coil or coils to induce a magnetic field in conductive material of the flywheel, in accordance with Faraday's law of induction. When the speed of the flywheel increases, the magnetic field in turn induces eddy currents in the conductive material of the flywheel that oppose the magnetic field in accordance with Lenz's law. The eddy currents and the magnetic field cooperate to generate a retarding eddy current brake torque $\tau_e$ (an example of the electromagnetic resistance mentioned earlier) in accordance with the Lorenz force law. The magnetic field induced by the eddy current brake coils and the resulting eddy current brake torque are proportional to the current driving the coils. Thus, the eddy current brake torque increases with both increasing flywheel speed and increasing coil current. This provides an opportunity for configuring the feel of and ergometer by controlling the coil current.

Assuming the flywheel has a moment of inertia $I_h$ and that $\tau_h$ is the handle torque proportional to the force felt by the rower at the handle, the equation for a configurable-feel ergometer's flywheel speed is $$I_h \frac{d\omega}{dt} = \tau_h - \tau_e - \tau_m$$

Thus, the rowing feel $f_h$ (that is, the resistance felt at the handle by the rower during the drive) of any given configurable-feel ergometer is proportional to the torque $\tau_h$:

$$f_h \propto I_h \frac{d\omega}{dt} + \tau_m + \tau_e$$

In particular the feel $f_h$ of any given configurable-feel ergometer can be adjusted using the eddy current brake torque $\tau_e$. Because the eddy current brake torque is subject to configuration across a broad range of values and can be subjected to changes at a high frequency, the rowing feel of the ergometer and every moment along the drive phase of the stroke can be configured to meet a wide range of target feels.

Because the eddy current brake torque increases with both increasing flywheel speed and increasing coil current, the eddy current brake torque can be configured based on measurements of the flywheel speed and control of the coil current. To measure the flywheel speed, a configurable-feel ergometer has a speed measurement device such as an encoder 48 (for example, a shaft angle encoder). To control the coil current, the ergometer has a coil current driver 50 that can apply (at an output of the driver) any current within a range of currents to the coil or coils in response to current magnitude instructions received at an input of the driver from an output of a microcontroller 52. An input of the microcontroller receives the measured speed $\omega_m$ from the encoder or other speed measuring device at a sampling rate of, for example, 240 Hz, and sends current magnitude instructions at an instruction cycle rate of, for example, 240 Hz to the coil current driver. The rate of speed sampling can be different from the rate at which instructions are sent (the instruction cycle rate), and the rate of each activity can be other than 240 Hz, either lower or higher. The rate could be any number larger than 10 Hz depending on the implementation.

Each current magnitude instruction carries data specifying a current $i_r$. Because the speed $\omega_m$ is measured and the eddy current brake torque corresponding to each current $i_t$ and speed $\omega_m$ is known empirically, the microcontroller can impart any target feel to the handle.

Eddy Current Brake Model

In order to be able to deliver at each instruction cycle the correct current magnitude instruction based on the desired eddy current brake torque and the measured speed, the microcontroller applies an inverse of the eddy current brake model. The eddy current brake model simulates the behavior of the eddy current brake including the relationships among coil current, flywheel speed, and torque. The model can be expressed using a variety of modeling techniques and the resulting model can range in complexity, size, and processing requirements from simple to complex. A tradeoff may be required between complexity or accuracy of the model and the ability of the microcontroller to store and process the model quickly enough to meet the speed measurement rate or the instruction cycle rate. Aspects of the tradeoff are discussed below.

The eddy current brake model can be installed in memory of the control circuitry at the time of manufacture and can be updated, revised, or enhanced from time to time by downloading through the Internet to the control circuitry, or from calculations based on real-time measurements. Changes in the model may result from a better understanding of the behavior of the eddy current brake or the ergometer, changes in approaches taken by manufacturers or suppliers of the ergometers, design changes in the eddy current brake, ergometer, current driver, microcontroller, or the computation algorithm, or changes can be based on real-time or post-processing of data from the machine itself using adaptive control, machine learning or other statistical or predictive mathematical techniques, or other factors.

Control System

Figure 5:
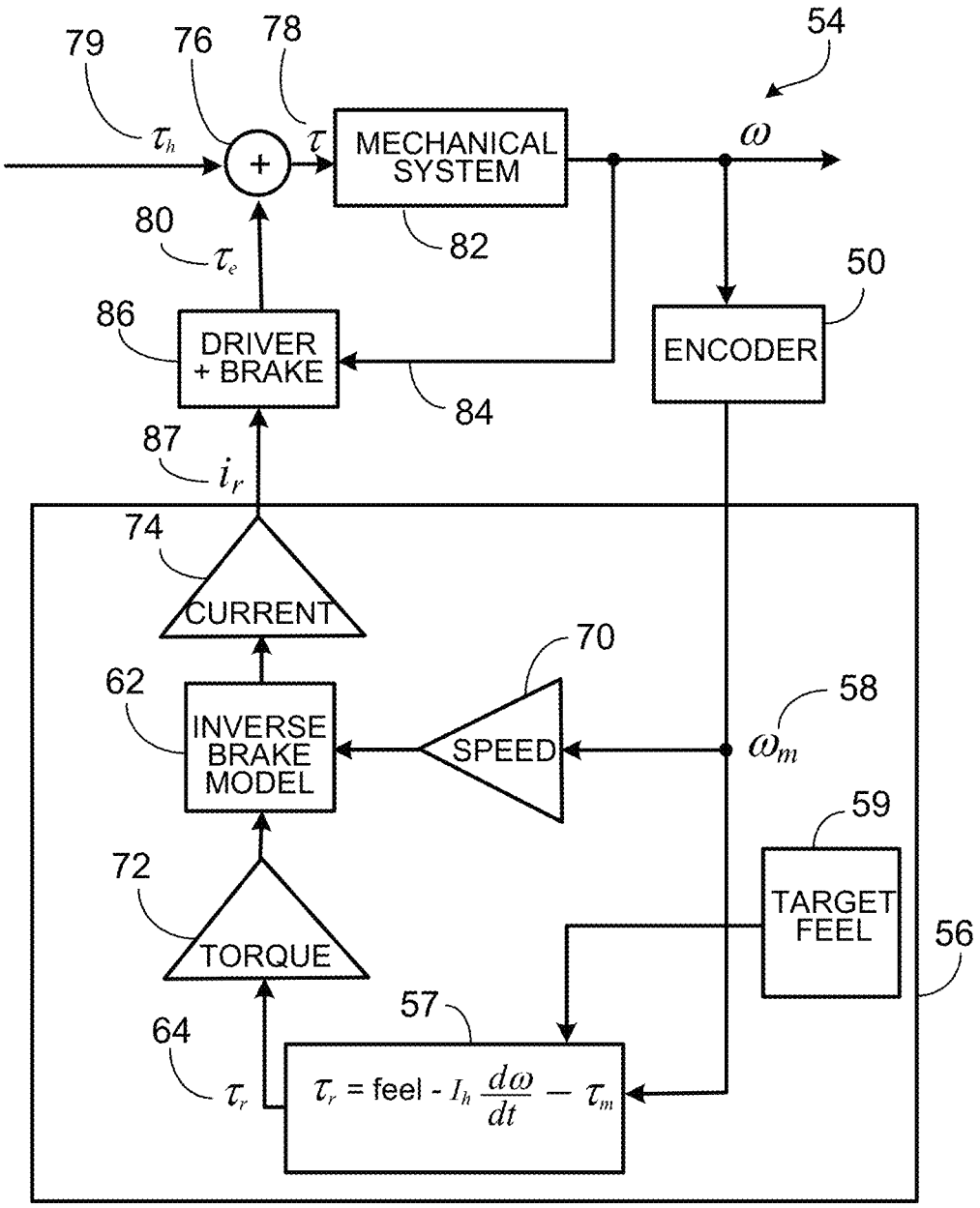
FIG. 5 is a block diagram of a control system for a machine.

FIG. 5 shows the configurable-feel ergometer's control circuitry 54. The microcontroller 56 reads the measured speed 58 received from the encoder 50 and calculates a requested torque $\tau_r$ 64. The requested torque for a given instruction cycle is calculated using a stored equation 57 that is expected to produce the target feel at the time of that instruction cycle given the input measured speed.

The target feel 59 can be stored in storage associated with the microcontroller at the time of manufacture. The target feel can be fixed and unchangeable for a given ergometer or can be changeable to define, update, edit, or replace a given target feel. When the target feel is changeable, for example, by altering stored target feel, the changes can be made over the Internet from a central server or, in some implementations, by manipulation of user interface controls by a user. In some cases, two or more different target feels can be stored and the user can be given the opportunities through a user interface of a device that is part of the ergometer to select a desired target feel.

The microcontroller must calculate the requested current $i_r$ 87 necessary to produce an eddy current brake torque 80 equal to the requested torque. This calculation relies on a stored inverse brake model 62 of the eddy current brake. In addition to the requested torque, the flywheel speed is also required as an input. In each instruction cycle, the microprocessor issues an instruction to the eddy current brake driver and eddy current brake 86 containing the value of the requested current. The driver and brake 86 produce a resulting eddy brake torque 80.

For example, if we want a configurable-feel ergometer to feel like a mechanical ergometer having a particular target feel, we can set $$\tau_r = (I - I_h)\frac{d\omega}{dt} - \tau_m + k\omega^2$$

If the inverse brake model is accurate, the resulting eddy current brake torque will be equal to the requested torque (i.e., $\tau_e = \tau_r$), and we can substitute the expression above for the eddy current brake torque in the equation for the feel of the configurable-feel ergometer. In this case, $$f_h \propto I_h\frac{d\omega}{dt} + \tau_m + (I - I_h)\frac{d\omega}{dt} - \tau_m + k\omega^2$$

Simplifying, $$f_h \propto I\frac{d\omega}{dt} + k\omega^2$$

FIG. 5 shows scaling factors for speed, torque, and current as triangles 70, 72, and 74, respectively. As indicated by element 76, the net torque $\tau$ 78 is the handle torque 79 applied by the user and offset by the opposing eddy brake torque 80. This net torque 78 is applied to the mechanical system (e.g., the flywheel and any associated mechanical losses $\tau_m$) 82. The connecting line 84 indicates that the speed of the flywheel will affect the eddy brake torque produced by the eddy current brake.

Therefore, as long as the inverse brake model is designed to enable the control circuitry to correctly calculate the requested current for a requested torque and the eddy current brake is capable of generating the requested torque as an eddy brake torque based on the requested current, the feel of the configurable-feel ergometer can be configured to match any target feel 59.

Setting a Target Feel

A wide variety of approaches could be used to setting a target feel or target feels of one or more ergometers. In some implementations, all of the ergometers of a given design or model can be preset with a particular fixed target feel, for example, a target feel corresponding to the feel of a particular model of mechanical ergometer. In some cases, ergometers of a given design or model can be organized in subsets and a common fixed target feel can be loaded for all of the ergometers of a given subset. Different fixed target feels can be applied to the ergometers of the different subsets.

A variety of objectives can be served by the selection of target feels. In some instances, the target feels can be selected to mimic existing ergometers to make users comfortable in using familiar target feels. In some applications, target feels can be created for experimentation or to provide a rowing experience having intended characteristics. Particular target feels can be applied for purposes of training or joint rowing by a group of growers or for competition or other purposes.

One or more target feels can be provided by a source that could include a manufacturer of ergometers. A market could be developed in which creators of new target feels could distribute them to owners of ergometers. In some implementations, the user of a given ergometer can be provided with user interface controls of a device on the ergometer or a wirelessly connected mobile device enabling the user to select available target feels or to create a wholly new target feel. In some examples, a user could be presented with information about a target feel, such as a graph showing the handle force versus position. Among other things, the user could be enabled to edit or alter the target feel through a user interface to create a new target feel and then have the new target feel applied to the operation of an ergometer.

In some implementations, a target feel could be something other than, but associated with the rowing feel, such as a heartbeat rate of a rower, skin resistance or any other measurable quantity.

A target feel need not remain fixed for every stroke of a rower using a configurable-feel ergometer. The target feel could vary from stroke to stroke, for example, randomly, or in a way that changes the target feel in a deliberate way over the course of a rowing session.

For example, to mimic a constant force associated with lifting a set of weights, the target feel would be a constant force on the handle. Other real or hypothetical forces that could be used in defining a target feel could include a term proportional to distance that would mimic the flexibility of an oar, a term proportional to the speed to mimic linear friction of the oar against the boat, or high force at the extreme positions x to mimic the travel limits of the oar. If the rower wears a heartbeat monitor, the target feel can be adjusted dynamically to maintain a constant heartbeat or to vary dramatically during with interval training. The target feel could also vary with the periods of the strokes in order to train the rower to have constant strokes per minute.

Secondary Factors

Although the eddy current brake torque is dominated by coil current and flywheel speed as explained earlier, there are also secondary factors that affect the eddy current brake torque. Some of the secondary factors are secondary variables that are harder to measure than coil current and flywheel speed and can also have a significant effect on the resulting eddy current brake torque.

These secondary variables include absolute temperature of the flywheel, temperature gradients across the flywheel, mechanical tolerances, and manufacturing variations, among others. For example, the absolute temperature of the steel in the flywheel and the materials of which the coil is made will affect the magnetic permeability and electrical conductivity of the materials. Changes in the temperature result in variations of the eddy current brake torque away from the basic intended eddy current brake model. Expansion and contraction of bearings and axles and support elements also can change stresses and the dynamics of the moving parts. Variations in manufacturing, repair, and assembly can also affect stresses and dynamics of the machine.

The secondary factors can also include limitations on the ability of the control circuitry to obtain good measurements and to complete complex and processor intensive computations quickly enough. For example, the microcontroller inevitably has limited processing speed, memory, and other computation resources.

Mechanical tolerances, manufacturing variations, and wear and tear also cause encoder wobble, which contaminates the speed measurements delivered to the microcontroller.

These secondary factors can change the feel of a configurable-feel ergometer from stroke to stroke and over the lifetime of the machine, as well as from machine to machine, and from any machine to any target feel. Thus, the secondary factors can degrade the accuracy of feel and precision of feel of a configurable-feel ergometer.

In order to improve both the accuracy and precision of every configurable-feel ergometer of a given model and of each configurable ergometer from stroke to stroke and over its lifetime, we propose several methods related to the measurement of deviations of feel, computation, and correction.

Simplification of the Computation

First we describe certain details related to the computations done by the microcontroller on the ergometer.

An eddy current brake function of the form $$\tau=e^{p_1}i^{p_2}\omega^{p_3}(\omega+\omega_0)^{p_4}=\mathrm{fun}(i,\omega)$$

can be used to express the behavior of an eddy current brake with a relatively small number of parameters $p_i$ required to define the function. Additionally, to reduce the computational load, the parameters $p_i$ can be computed using a linear least squares regression given a set of measurements that relate current, speed, and torque, by taking logarithms as follows:

$$\ln \tau=p_1+p_2 \ln i+p_3 \ln \omega+p_4 \ln(\omega+\omega_0)$$

Several of these measurements can be expressed in matrix form as follows:

$$\begin{bmatrix} \vdots & \vdots & \vdots & \vdots \\ 1 & \ln i & \ln \omega & \ln(\omega+\omega_0) \\ \vdots & \vdots & \vdots & \vdots \end{bmatrix} \begin{bmatrix} p_1 \\ p_2 \\ p_3 \\ p_4 \end{bmatrix} = \begin{bmatrix} \vdots \\ \ln \tau \\ \vdots \end{bmatrix}$$

However, the microcontroller needs to invert this function in order to find the requested current $i_r$ to be included in an instruction to the eddy current brake, based on a requested torque and a measured speed. The microcontroller may not have the necessary computational capabilities to carry out these calculations at 240 Hz, for example. Storing an approximation of this function as a torque table in storage associated with the microcontroller allows quick inversion (computation of the necessary current from the requested torque) using a bilinear approximation:

$$\begin{bmatrix} i_0 \\ i_1 \\ \vdots \end{bmatrix} \begin{array}{c} [\omega_1 \ \omega_2 \ \cdots] \\ \begin{bmatrix} \tau_{0,0} & \tau_{0,1} & \cdots \\ \tau_{1,0} & \tau_{1,1} & \cdots \\ \vdots & \vdots & \ddots \end{bmatrix} \end{array}$$

During the recovery phase of rowing, the equation for the flywheel speed reduces to $$I_h \frac{d\omega}{dt} = -\tau_e - \tau_m$$

The mechanical torque $\tau_m$ due to mechanical losses can be captured using an affine model, especially since its contribution is much less than that of the eddy current brake torque, $$\tau_m = a_m \omega + b_m$$

Assuming the current is constant, the eddy current brake torque from the bilinear approximation will also be affine, $$\tau_e = a_e \omega + b_e$$

The resulting equation for the speed, is separable and can be calculated in closed form:

$$\frac{d\omega}{a\omega + b} = -\frac{dt}{I_h},\ a = a_m + a_e,\ b = b_m + b_e$$

$$\omega(t) = \left(\omega_0 + \frac{b}{a}\right) e^{-\frac{a(t-t_0)}{I_h}} - \frac{b}{a},\ \omega(t_0) = \omega_0$$

The closed form solution is more precise and computationally efficient and avoids the need to estimate the torque using a derivative.

Additionally, if we assume a configurable-feel ergometer is mimicking a mechanical ergometer having a moment of inertia I and a drag factor k, during recovery the equation for speed reduces to $$I \frac{d\omega}{dt} = -k\omega^2 \Rightarrow \frac{d\omega}{k\omega^2} = -\frac{k}{I} dt$$

Such that $$\omega(t) = \frac{\omega_0}{1 + \omega_0 \frac{k}{I}(t - t_0)},\ \omega(t_0) = \omega_0$$

Again, the closed form solution is more precise and computationally efficient and avoids the need to estimate a derivative.

FIG. 5 shows scaling factors for torque $G_t$, current $G_c$ and speed $G_s$ such that $$G_t \tau_r = \text{fun}\left(\frac{i_r}{G_c}, G_s \omega_m\right) \Rightarrow i_r = G_c \text{fun}^{-1}(G_t \tau_r, G_s \omega_m)$$

These factors allow real-time adjustments to the eddy current brake model without the need to recompute the torque table.

Measurements

FIG. 5 shows the actual rowing feel on the handle 79 is equal to the torque applied to the mechanical system 78 offset by the eddy current brake torque 80. The goal of the control circuitry of the configurable-feel ergometer is to minimize the deviation between the actual rowing feel on the handle and the intended target feel 59 in each instruction cycle of the control circuitry. For this purpose, it would be useful to be able to measure the actual rowing feel. However, a configurable-feel ergometer may not have a load cell or other force measurement device to directly measure the actual rowing feel on the handle.

Figure 6:
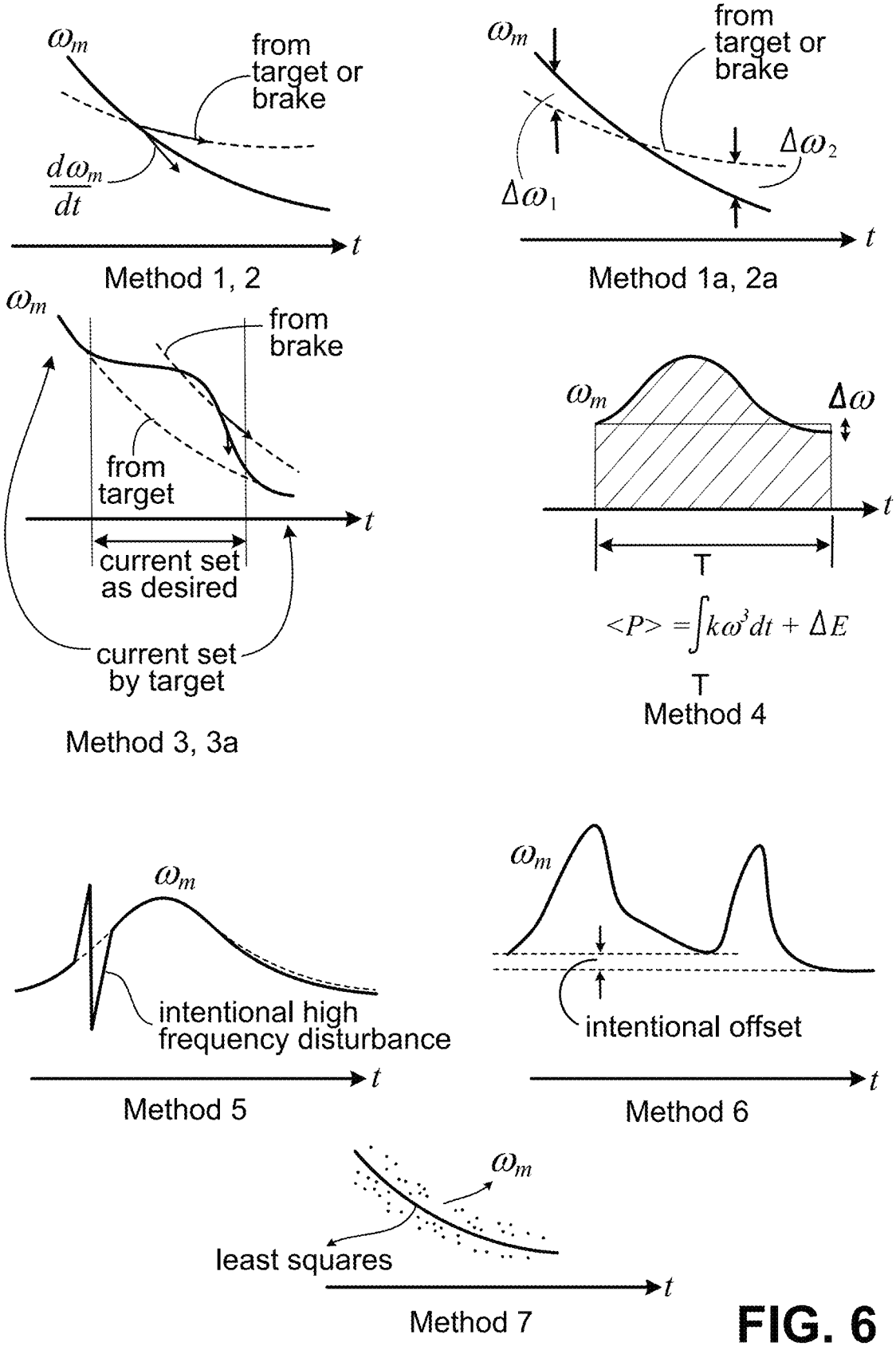
FIG. 6 shows methods of measuring rowing feel.

In some implementations, the actual rowing feel of the machine can be measured indirectly using primarily the flywheel speed. FIG. 6 illustrates methods for measuring the actual rowing feel directly as described below. In determining the actual rowing feel, combinations of two or more of the described methods could also be used.

In some implementations, it is not necessary to calculate the difference between the measured feel and the target feel exactly, but only to obtain a proxy measurement that will tend to zero if the measured feel matches the target feel. In nonlinear control, this is known as a Lyapunov function. We refer to this as "quantifying the difference in feel", as opposed to precisely measuring the difference between forces at the handle at all times.

Several of the methods described below are applied during the recovery phase of a rowing stroke. The torque applied to the flywheel from the rower is zero during recovery. Among the advantages of such methods are that, to the extent that the rower is unaware of or unconcerned about the speed of the flywheel during recovery it is possible to apply "tests" to the flywheel braking during recovery which can improve the accuracy of such methods.

Other methods rely on the band of frequencies and magnitudes where a rower can perceive a change. In particular, the force at the handle can change faster than what the rower can feel, but be measurable by the control system. Alternatively, changes below certain magnitudes can also be imperceptible to the rower, but still deliver statistically significant data over several measurements.

Rate of Change of Speed Against Target During Recovery (Method 1)

As mentioned, if a configurable-feel ergometer is mimicking a mechanical ergometer, the expected rate of change, or time derivative, of the speed (i.e., the speed derivative) during recovery is given by $$\frac{d\omega}{dt} = -\frac{k}{I}\omega^2$$

In examples in which the configurable-feel ergometer's speed measurements are updated at 240 Hz, we can estimate the speed derivative in real time as $$\frac{d\omega_m}{dt} \approx (\omega_m - \omega_{m-1}) \cdot 240 \text{ Hz}$$

where $\omega_{m-1}$ is the previous speed measurement. We can quantify the deviation of the actual feel from the target feel using the difference between these derivatives, such that $$\frac{d\omega_m}{dt} - \frac{d\omega}{dt} = \frac{d\omega_m}{dt} + \frac{k}{I}\omega^2$$

This computation is sensitive to high frequency noise, and carries the errors of the estimation of the derivative.

As an example, we can calculate the expected difference between the estimated and the expected speed derivatives if the actual drag factor is k+Δk:

$$\frac{d\omega_m}{dt} + \frac{k}{I}\omega^2 = -\frac{\Delta k}{I}\omega^2$$

However, differences between actual feel and target feel can be caused by other variations (other than linear differences in drag factor of the form k+Δk) that may affect variables other than the derivative during recovery. In particular, variations may affect multiple variables simultaneously, or the relationships between variations and measurements may be nonlinear.

Speed Against Target During Recovery (Method 1a)

Instead of computing the difference between speed derivatives, we can take advantage of the closed-form solution for the speed of a mechanical ergometer during recovery $$\omega(n) = \frac{\omega_0}{1 + \omega_0 \frac{k}{I} \frac{n}{240}}$$

where n is the number of measurements taken since $\omega_0$. We can quantify the deviation of the actual feel from the target feel as $$\omega_m - \omega(n) = \omega_m - \frac{\omega_0}{1 + \omega_0 \frac{k}{I} \frac{n}{240}}$$

This method avoids the noise associated with computing a derivative and the error of the approximation for the derivative. However, the error computed by this method is integrated over a large range of speeds, and it is less meaningful to measure a deviation given that the subsequent errors get added to the sum of all previous ones. Furthermore, this measurement depends very strongly on how long we wait after the initial time for the measured speed.

Rate Against Brake During Recovery (Method 2)

This method is similar to the measurement of differences between speed derivatives, but in this case, we calculate the expected speed derivative using the eddy current brake model to calculate $\tau_e$ and a loss model to calculate $\tau_m$ $$\frac{d\omega}{dt} = -\frac{fo o_{EB}(i_r, \omega_m)}{I_h} - \tau_m$$

and quantify the difference as $$\frac{d\omega_m}{dt} - \frac{d\omega}{dt}$$

As in the case of the difference based on the speed derivative against the target speed derivative, this calculation is sensitive to noise and includes the error of the approximation of the derivative. However, it decouples the quantification of difference of feel from the target, making this measurement of the configurable-feel ergometer independent of the target feel.

Speed Against Brake During Recovery (Method 2a)

As in the case of the difference between measured speed and a target speed, the closed-form solution for the speed given the torque predicted by the eddy current brake model is $$\omega_m - \omega(n) = \omega_m - \left(\omega_0 + \frac{b}{a}\right) e^{-\frac{a}{I_h}\frac{n}{240\ Hz}} - \frac{b}{a}$$

As expected, this method decouples the measurement of actual feel from the target feel, and avoids both noise and derivative errors, but the error is still cumulative and dependent on the time interval.

Rate or Speed Against Brake During Recovery with Test (Methods 3 and 3a)

In both methods where we compute the difference of actual speed derivative against the speed derivative predicted by the eddy current brake model, the current $i_r$ would typically still be given by the target feel. The range of this current during recovery is typically smaller than the range during the drive.

However, assuming the rower is unaware of or unconcerned about the speed of the flywheel during recovery, the only speed that matters to the rower is the speed at the next catch. FIG. 7 shows that if we keep track of what the value of the speed should be according to the target feel, we can ignore the current given by the target feel for a while and set larger or smaller values for the current, as long as the speed returns to the value predicted using the target feel before the next catch. We refer to this as a "test".

In this method, the difference between actual feel and the expected feel scan be quantified using the speed derivatives or the speed, but with the advantage that the range of currents tested can be similar to those applied during the drive and in the range for which the rower feels the response of the configurable-feel ergometer.

As with method 1 and method 2, method 3 can be divided into two separate methods 3 and 3a in a similar way.

Power Calculation Across Full Stroke (Method 4)

If the eddy brake torque is actually equal to the requested torque throughout a full stroke, the energy delivered by the rower over a stroke is expected to be $$\sum_n \tau_r \omega_m \frac{1}{240\ \text{Hz}}$$

where the sum is over all values at a succession of all instruction cycles during a stroke. Likewise, the energy delivered by the rower over a stroke, assuming the configurable-feel ergometer mimics a mechanical ergometer can be measured as $$\sum_n k\omega_m^3 \frac{1}{240\ \text{Hz}} + \frac{1}{2}\omega_{next_catch}^2 - \frac{1}{2} I \omega_{catch}^2$$

where the sum is again over the same stroke and the speeds are the speeds at the start and at the end of the stroke. The deviation of the actual feel from the target feel can be quantified using the difference between the expected and measured energies over the full stroke.

This measurement is quite robust against noise, but can only deliver a value every stroke and assumes the inertial component of the requested torque is accurate. It is also more computation and memory intensive.

High Frequency Disturbance (Method 5)

The power calculation method 4 allows us to quantify a deviation of the actual feel from the target feel throughout the whole stroke, including the drive. In order to increase the range of currents and speeds tested, we can add a zero mean torque signal to the requested torque at frequencies above the rower's ability to perceive.

Low Frequency Disturbance (Method 6)

Similar to the previous method 5, we can also inject a low frequency torque signal as long as its amplitude is below the rower's ability to perceive. This method would be useful to check against long-term deviations using statistical analysis, machine learning, or other mathematical techniques applied to the data across multiple strokes.

Least Squares During Recovery (Method 7)

Instead of trying to compute a deviation between the torque of the actual feel and the torque of the target feel immediately, we can estimate the instantaneous torque during recovery using $$\tau_e = I_h \frac{d\omega_m}{dt} \approx I_h(\omega_m - \omega_{m-1}) \cdot 240 \text{ Hz}$$

and then store the speed, current, and torque estimate across several strokes. As explained in the computation section, the eddy current brake model equation has been designed to allow the use of linear least squares in order to compute a new torque table using this data. However, this method is the most memory intensive since it requires storing a large amount of raw measurements before processing can be done.

Corrections of Feel

Once there is a reliable quantification of the deviation of the actual feel from the target feel, there are several ways to change the behavior of the configurable-feel ergometer in order to improve its accuracy of feel and precision of feel in mimicking the target feel. One or any combination of two or more of the following methods could be used:

Adjust the Target Feel

FIG. 8 shows a method comprised of a feedback loop (illustrated by thick lines in the figure) in which the actual feel is adjusted based on a difference between the actual feel and the target feel. A wide variety of control transfer functions could be used in the feedback loop. However, a simple PID control, or even just proportional control, could be selected because they are not computationally intensive and can easily be done in real time.

However, this feedback loop method links an adjusted target feel to each specific configurable-feel ergometer. Thus, adjusting the target feel for all ergometers of a given model or design can have an impact on the precision of feel and accuracy of feel for each given ergometer, which is undesirable. That is, the precision of feel and accuracy of feel of a particular configurable-feel ergometer should be independent of the target feel.

Adjust the Torque, Current and/or Speed Gains

FIG. 8 shows that the eddy current brake model can be adjusted using the torque gain value, the current gain value, or the speed gain value, or combinations of two or more them. Adjusting any of these gain values has benefits and disadvantages that can be both predicted mathematically and demonstrated using data. The choice of using any one of these adjustments or combinations of two or more of them can be made based on such mathematical predictions and data demonstrations.

Each of these adjustments is implemented using a feedback loop, and a wide variety of control transfer functions can be implemented. However, a simple PID, or even just proportional control is not computationally intensive and can easily be done in real time.

Additionally, this method respects the abstraction barrier between the internal eddy current brake model of the configurable-feel ergometer and the target feel.

Recompute the Torque Table

This method is the most precise since it would change the shape of the torque function represented by the torque table to reflect the actual behavior of the eddy current brake and the rest of the mechanical system.

However, while the microcontroller is capable of performing a linear least squares regression (including the computation of logarithms), this computation may push the computational resources of the microcontroller to their limits. In particular, this technique requires storing values with higher precision and (depending on the nature of the microcontroller) can take at least a couple of seconds after the data is collected to complete the computation. Thus, in some examples, it cannot be done in real time, since it can be done reliably only after at least a few strokes have been stored in memory.

Additionally, this technique does not represent a gradual adjustment, as in the previous correction methods. Errors in the data or in the computation can result in step deviations that yield abrupt changes to the actual feel. Other safeguards can be used to mitigate this concern, such as gradually moving to the new feel or rejecting results with large step changes or a combination of them, but these safeguards increase complexity and computational cost.

Other Implementations

Other implementations are also within the scope of the following claims.

For example, although the examples discussed above apply to ergometers having rotating flywheels as the movable inertial element, other movable inertial elements and associated electromagnetic actuators might be used, such as a linear resistance element and its associated eddy current brake, or other electromagnetic actuator. We use the term "movable inertial element" broadly to include, for example, any movable device coupled to the handle or other grip and that cooperates with an eddy current brake to impose desired forces as part of an intended rowing feel of an ergometer.

The invention claimed is:

1. A rowing exercise machine comprising:

a movable inertial element, an eddy current brake coupled to the movable inertial element, a rowing grip coupled to the movable inertial element, and control circuitry coupled to the eddy current brake, the control circuitry configured to cause the eddy current brake to provide a resistance to motion of the rowing grip during part or all of a rowing stroke that conforms to a target resistance to motion of the rowing grip, wherein the control circuitry is configured to adjust one or more parameters of a control model of the rowing exercise machine iteratively as part of a feedback loop in real-time during motion of the rowing grip, the feedback loop including an iterative adjustment of a current applied to the eddy current brake.

2. The rowing exercise machine of claim 1 in which the information contained in the storage is not changeable.

3. The rowing exercise machine of claim 1 in which the information contained in the storage is changeable to information received at the rowing exercise machine through the Internet.

4. The rowing exercise machine of claim 1 in which the information contained in the storage is changeable in response to inputs from user interface controls of a user interface.

5. The rowing exercise machine of claim 1 in which the target resistance to motion comprises a resistance to motion of an existing model or design of a mechanical ergometer.

6. The rowing exercise machine of claim 1 in which the target resistance to motion is the same as a target resistances to motion of another rowing exercise machine of a given model or design.

7. The rowing exercise machine of claim 1 in which the target resistance to motion applies to a series of successive strokes during a rowing session of a rower.

8. The rowing exercise machine of claim 1 in which the target resistance to motion is different for different strokes during a rowing session of a rower.

9. The rowing exercise machine of claim 1 in which the resistance to motion of the rowing grip caused by the control circuitry is based on one or more parameter values, and the parameter values comprise one or more of: position of the rowing grip, velocity of the rowing grip, ambient temperature, timing in relation to a training schedule, heart rate of a user, skin resistance of the user, and intervention by an observer.

10. The rowing exercise machine of claim 1, wherein the one or more parameters of the control model of the rowing exercise machine comprises at least one of a torque gain, a current gain, or a speed gain.

11. The rowing exercise machine of claim 1, wherein the control circuitry stores an approximation of a relationship between the current applied to the eddy current brake and a torque value, and wherein the control circuitry is configured to determine the current applied to the eddy current brake based on a torque table.

12. The rowing exercise machine of claim 11, wherein the approximation of the relationship comprises a torque table, and wherein the control circuitry is configured to recompute the torque table during the motion of the rowing grip so as to decrease a difference between the resistance to motion of the rowing grip and the target resistance to motion of the rowing grip.

13. The rowing exercise machine of claim 1, wherein the control circuitry is configured to, during a recovery phase of the rowing stroke, test a response of the eddy current brake to a test current that is different from a current associated with conforming the resistance to motion of the rowing grip to the target resistance to motion of the rowing grip.

* * * * *